US005251955A

United States Patent [19]

Sarafa

[11] Patent Number: 5,251,955

[45] Date of Patent: Oct. 12, 1993

[54] TRANSPORTABLE PICNIC TABLE

[76] Inventor: Hani N. Sarafa, 4756 Fairway Ridge South, West Bloomfield, Mich. 48323

[21] Appl. No.: 855,723

[22] Filed: Mar. 20, 1992

[51] Int. Cl.[5] ..... A47B 39/00

[52] U.S. Cl. ..... 297/157; 297/99

[58] Field of Search ..... 297/135, 157, 158, 159, 297/174, 442; 108/111, 99

[56] References Cited

U.S. PATENT DOCUMENTS

| | | | |
|---|---|---|---|
| D. 171,751 | 3/1954 | Curtis | 297/157 X |
| D. 295,123 | 4/1988 | Roberson, Sr. | D6/430 |
| 2,522,774 | 9/1950 | Bower | 297/442 X |
| 3,300,245 | 1/1967 | Rumble | 297/157 |
| 4,076,305 | 2/1978 | Sullivan | 108/99 X |
| 4,537,443 | 8/1985 | Bray | 297/159 |
| 4,607,880 | 8/1986 | Gastebled | 297/157 |
| 4,648,652 | 3/1987 | Van Kuren | 297/159 |
| 4,700,986 | 10/1987 | Davis | 297/157 |
| 4,700,987 | 10/1987 | Sraka et al. | 297/159 |
| 4,740,032 | 4/1988 | Olsen | 297/157 |
| 4,834,450 | 5/1989 | Stickler | 297/157 |

*Primary Examiner*—Laurie K. Cranmer
*Attorney, Agent, or Firm*—Brooks & Kushman

[57] ABSTRACT

A transportable picnic table is disclosed comprising a pair of generally planar bases, a pair of elongated seats, a tabletop, and three support ribs hingedly attached to the seats and to the tabletop, respectively. Each of the bases includes opposite leg portions adapted to rest on a support surface and a central portion extending between the leg portions. Side notches are formed in each of the leg portions and a middle notch is formed in the central portion Lateral grooves are formed in the opposite ends of the seats and the tabletop. The grooves removably receive the bases so that the seats and the tabletop extend between the bases. The ribs are movable between a collapsed position where they lie parallel to the seats and to the tabletop, respectively, and an assembled position where they are perpendicular to the seats and to the tabletop, respectively, and fit respectively into the side notches and the middle notch of the bases. The combination of interlocking components provides a picnic table that is both stable and transportable.

11 Claims, 2 Drawing Sheets

TRANSPORTABLE PICNIC TABLE

TECHNICAL FIELD

This invention relates to picnic tables and, more particularly, to a picnic table which can be disassembled and transported in a carrying case.

BACKGROUND ART

Picnic tables that can be disassembled or folded up for storage or transport are well known. Many designs for such picnic tables include a tubular frame upon which the tabletop and benches are mounted. See, for example, U.S. Pat. No. 4,040,658 to Mayol and U.S. Pat. No. 4,607,880 to Gastebled.

Other designs have been proposed in which all the major components of the picnic table are flat wooden pieces, with no tubular frame. U.S. Pat. No. 4,076,305 to Sullivan, for instance, discloses a knockdown mobile picnic table and bench assembly. Cooperating tab elements and apertures releasably interlock a pair of bench members and a table top with a pair of leg members. Wooden tabs and apertures, however, are likely to suffer dimensional changes as the wood wears, and the resulting looser tolerances may compromise the stability of the assembled picnic table.

When disassembled, the picnic table disclosed by Sullivan may be rolled about on wheels. Although this design is not easily hand carried or transported in the trunk of an automobile, U.S. Pat. No. 4,064,812 to Commanda discloses a picnic table that folds up and includes a handle so the unit can be carried. Unfortunately, the picnic table taught by Commanda does not include benches.

SUMMARY OF THE INVENTION

The present invention is a novel transportable picnic table. The transportable picnic table comprises a pair of generally planar bases, a pair of elongated seats, a tabletop, and three support ribs hingedly attached to the seats and to the tabletop, respectively. Each of the bases includes opposite leg portions adapted to rest on a support surface and a central portion extending between the leg portions. Side notches are formed in each of the leg portions and a middle notch is formed in the central portion.

Lateral grooves are formed in the opposite ends of the seats and the tabletop. The grooves removably receive the bases so that the seats and the tabletop extend between the bases. The ribs are movable between a collapsed position where they lie parallel to the seats and to the tabletop, respectively, and an assembled position where they are perpendicular to the seats and to the tabletop, respectively. In the assembled position, the ribs fit, respectively, into the side notches and the middle notch of the bases. The combination of interlocking components provides a picnic table that is both stable and transportable.

Accordingly, it is an object of the present invention to provide a transportable picnic table of the type described above which can be constructed entirely from standard plywood, without the need for metallic or tubular components other than hinges.

Another object of the present invention is to provide a transportable picnic table of the type described above which can be assembled and disassembled without the use of any tools.

Another object of the present invention is to provide a transportable picnic table of the type described above which remains stable even as it is subject to wear.

Still another object of the present invention is to provide a transportable picnic table of the type described above which is transportable in a carrying case.

A more specific object of the present invention is to provide a transportable picnic table of the type described above which can be hand carried, or transported in the trunk of a vehicle.

These and other objects, features, and advantages of the present invention are readily apparent from the following detailed description of the best mode for carrying out the invention when taken in conjunction with the accompanying drawings.

BEST MODE FOR CARRYING OUT THE INVENTION

Figure 1:
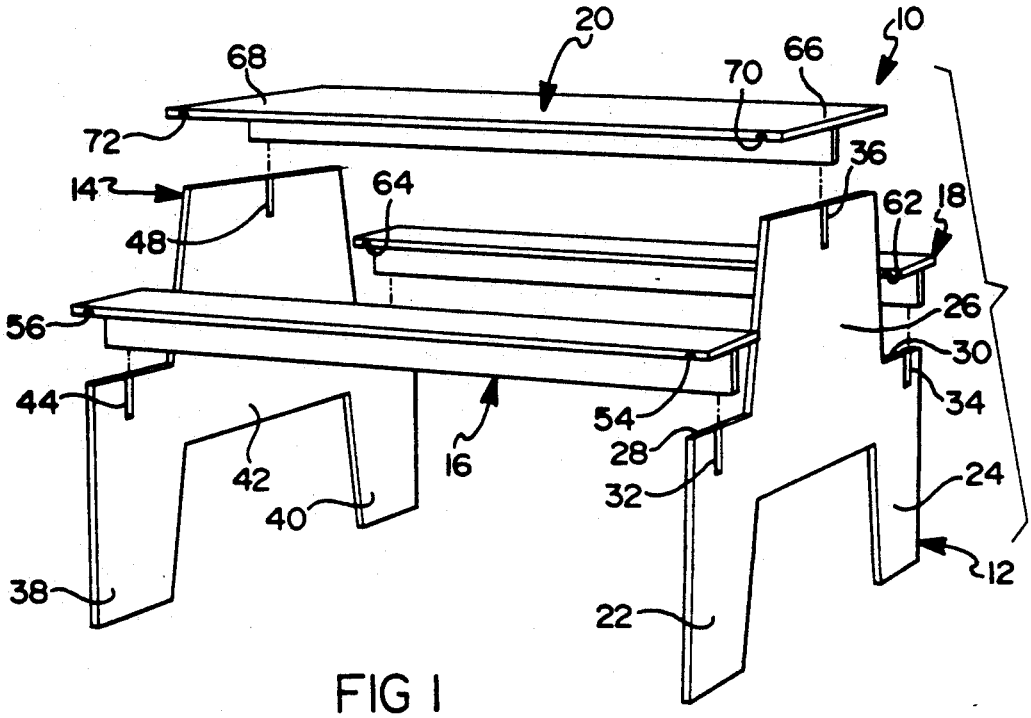
FIG. 1 is an exploded top perspective view of a transportable picnic table according to the present invention.
Figure 2:
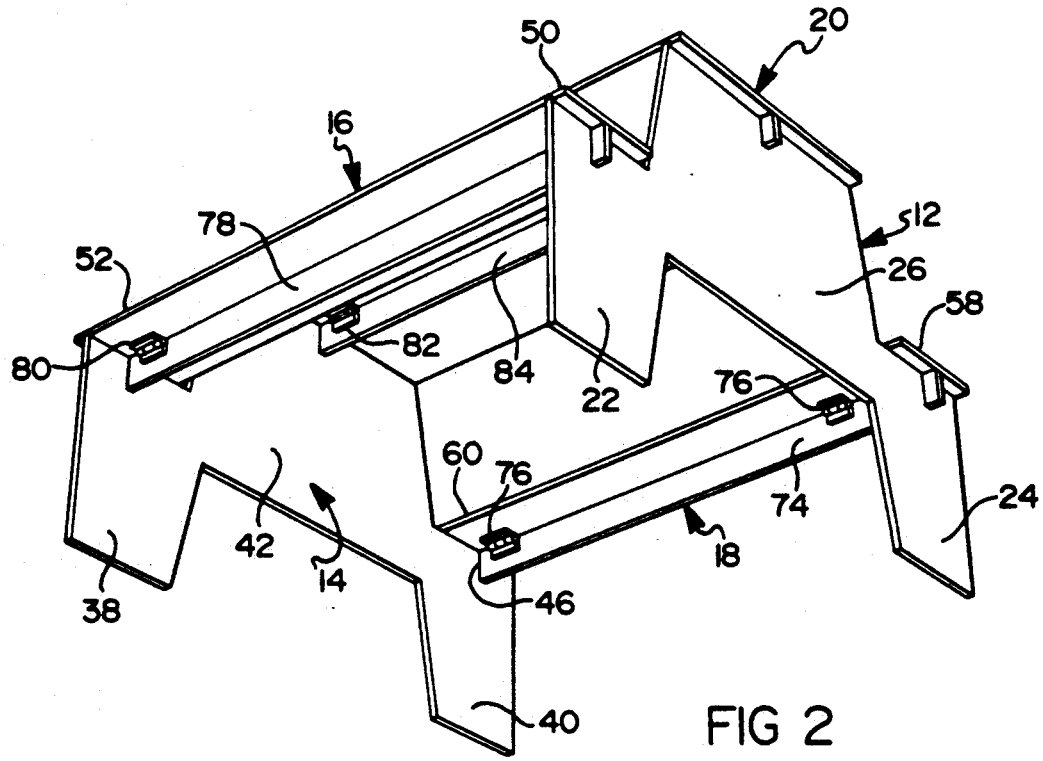
FIG. 2 is a bottom perspective view of the transportable picnic table assembled for use.
Figure 3:
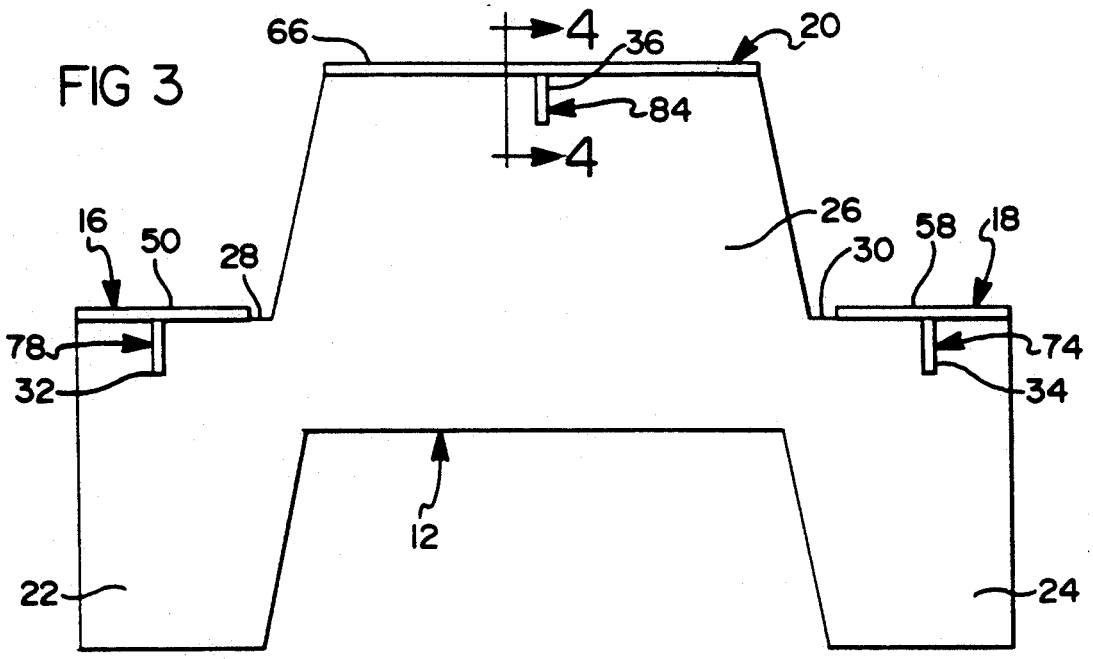
FIG. 3 a side view of the transportable picnic table.

With reference to the drawings, the preferred embodiments of the present invention will be described. FIGS. 1-3 show a transportable picnic table designated generally by the reference numeral 10. The transportable picnic table 10 comprises a pair of bases 12 and 14, a pair of elongated seats or benches 16 and 18, and a tabletop 20.

The bases 12 and 14 are generally planar, and are preferably formed from a standard sheet of ¼ inch or ½ inch plywood, as described more fully below. The base 12 includes opposite leg portions 22 and 24 which are adapted to rest on a support surface such as the ground. A central portion 26 extends between and rises above the leg portions 22 and 24 to define shoulders 28 and 30. Side notches 32 and 34 are formed, respectively, in the shoulders 28 and 30 of the leg portions 22 and 24, and a middle notch 36 is formed in the top of the central portion 26. The other base 14 is similarly constructed, with leg portions 38 and 40 flanking a central portion 42, and notches 44, 46, and 48 formed in the leg portions 38 and 40 and the central portion 42, respectively.

The seat 16 has a first end 50 and a second end 52. A groove 54 is formed proximate the first end 50 of the seat 16, and another groove 56 is spaced apart from the first groove 54 and formed proximate the second end 52 of the seat 16. Both of the grooves 54 and 56 extend in a substantially lateral direction, generally perpendicular to the direction in which the seat 16 is elongated. The grooves 54 and 56 are adapted to receive the shoulder of one of the associated bases 12 or 14 so that the seat 16 extends between the bases. The other seat 18 similarly includes a first end 58 and a second end 60 formed with lateral grooves 62 and 64 which receive the bases 12 and 14, respectively.

The rectangular tabletop 20 has a first end 66 and a second end 68. A pair of spaced-apart lateral grooves 70 and 72 are formed proximate the first and second ends 66 and 68 of the tabletop 20, respectively. Like the grooves in the seats 16 and 18, each of the grooves 70 and 72 is adapted to receive an associated base 12 or 14 so that the tabletop 20 extends between the bases.

As best shown in FIG. 2, the seat 18 is pivotally attached to an elongated support rib 74 by two hinges 76. Seat 16 is similarly hingedly attached to another elongated support rib 78 by hinges 80, and the tabletop 20 is pivotally attached by hinges 82 to a third elongated support rib 84. Because they are hinged, the ribs 74, 78, and 84 are movable between a collapsed position and an assembled position In the assembled position shown in FIGS. 1 through 4, the ribs 74, 78, and 84 extend substantially perpendicular to the seats 16 and 18 and to the tabletop 20, respectively. When they are so extended, the ribs are adapted to fit, respectively, into the side notches and the middle notch of the bases to stabilize the picnic table. Because the seats 16 and 18 and the tabletop 20 are perfectly symmetrical, the hinges 76, 80, and 82 may be arranged to face inwardly or outwardly without affecting the performance of the picnic table. When assembled, the picnic table is approximately 42 inches long by 43 inches wide (including the seats) by 26θ inches high.

Figure 4:
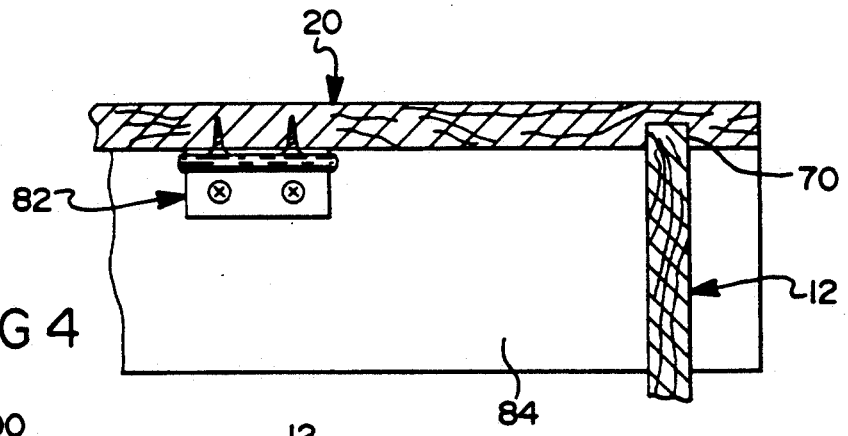
FIG. 4 is a partial cross-sectional view.

FIG. 4 shows the intersection of base 12, tabletop 20, and support rib 84. The hinge 82 is secured to the tabletop 20 by screws 86, and to the support rib 84 by screws 88. The top of the base 12 is removably received in the groove 70 and maintains stability even as the wood wears. Dimensional tolerances stay even though the wood wears. The notch and groove concept eliminates the need for any type of fastener or tool to erect and knock down the picnic table. Therefore, assembly and disassembly is made very simple and fast. Furthermore, the dimensional tolerances between the notches and grooves, and the pieces that are received therein, retain their original integrity. The picnic table 10 thus remains relatively stable even when exposed over time to wear.

Figure 5:
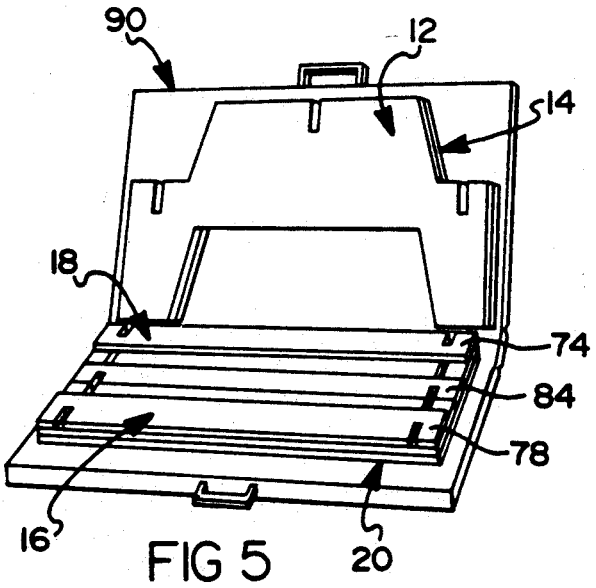
FIG. 5 is a perspective view of the transportable picnic table disassembled and packed in an open carrying case.
Figure 6:
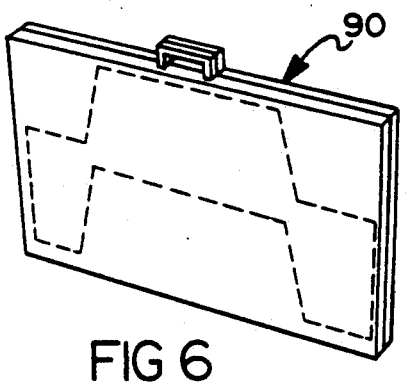
FIG. 6 is a perspective view similar to FIG. 5 and showing the carrying case closed.

FIGS. 5-6 show the picnic table 10 disassembled and collapsed for storage and transportation in a carrying case 90. In the collapsed position, the support ribs 74, 78, and 84 lie substantially parallel and adjacent to the seats 16 and 18 and to the tabletop 20, respectively. Preferably, the seats, tabletop, ribs, and bases are all cut from standard plywood such that when broken down, the maximum dimensions of the components fit within the 27"×43"×3" carrying case 90. Including the carrying case 90, the collapsed picnic table weighs only about 30 pounds. It is, therefore, easily carried by hand, or deposited in the trunk of an automobile for transportation to a more distant location.

It requires just over four sheets of 4'×8'×½" plywood to make five picnic tables of the type described above. From the first sheet, five bases measuring 43 inches long by 26 inches high are cut. Three support ribs measuring 3½ inches by 42 inches are then cut from the perimeter of the sheet. A second sheet is similarly cut, for a total of ten bases and six support ribs.

From a third sheet, four tabletops measuring 20 inches by 42 inches are cut, along with one seat measuring 8 inches by 42 inches and four support ribs each measuring 3½ inches by 42 inches. The fourth sheet is dissected to yield nine seats, one tabletop, and two support ribs. Altogether, this yields almost all the components for five transportable picnic tables according to the present invention, with little wasted plywood.

It should be understood that while the forms of the invention herein shown and described constitute preferred embodiments of the invention, they are not intended to illustrate all possible forms thereof. It should also be understood that the words used are words of description rather than limitation, and various changes may be made without departing from the spirit and scope of the invention disclosed.

I claim:

1. A transportable picnic table comprising:
   - a pair of bases, each base having two side notches and a middle notch;
   - a pair of seats, each seat having a first end, a second end, and a pair of spaced apart grooves, each of the grooves being adapted to receive one of the bases so that the seats extend between the bases;
   - a tabletop having a first end, a second end, and a pair of spaced apart grooves, each of the grooves being adapted to receive one of the bases so that the tabletop extends between the bases;
   - a first rib attached to one of the seats;
   - a second rib attached to the other of the seats; and a third rib attached to the tabletop;
   - the first, second, and third ribs being pivotally attached to the seats and to the tabletop, respectively, and movable between a collapsed position where they lie substantially parallel to the seats and to the tabletop, respectively, and an assembled position whereby they are adapted to fit, respectively, into the side notches and the middle notch of the bases to stabilize the picnic table.

2. The transportable picnic table of claim 1 wherein the first, second, and third ribs in the collapsed position lie adjacent to the seats and to the tabletop, respectively.

3. The transportable picnic table of claim 1 wherein the first, second, and third ribs in the assembled position extend substantially perpendicular to the seats and to the tabletop, respectively.

4. The transportable picnic table of claim 1 wherein each of the bases is generally planar.

5. The transportable picnic table of claim 1 wherein each of the bases comprises opposite leg portions adapted to rest on a support surface and a central portion extending between the leg portions.

6. The transportable picnic table of claim 5 wherein the side notches are formed in the leg portions and the middle notch is formed in the central portion.

7. The transportable picnic table of claim 1 wherein the grooves in the seats and in the tabletop extend in a substantially lateral direction.

8. The transportable picnic table of claim 1 wherein the grooves in the seats are formed proximate the first and second ends of the seats, respectively.

9. The transportable picnic table of claim 1 wherein the grooves in the tabletop are formed proximate the first and second ends of the tabletop, respectively.

10. The transportable picnic table of claim 1 wherein the first, second, and third ribs are pivotally attached by a plurality of hinges.

11. A transportable picnic table comprising: a pair of generally planar bases, each of the bases
   - including opposite leg portions adapted to rest on a support surface and a central portion extending between the leg portions, each base having a side notch formed in each of the leg portions and a middle notch formed in the central portion;
   - a pair of seats, each seat having a first end, a second end, and a pair of spaced apart grooves formed proximate the first and second ends of the seats, respectively, each of the grooves extending in a substantially lateral direction and being adapted to receive one of the bases so that the seats extend between the bases;

a tabletop having a first end, a second end, and a pair of spaced apart grooves formed proximate the first and second ends of the tabletop, respectively, each of the grooves extending in a substantially lateral direction and being adapted to receive one of the bases so that the tabletop extends between the bases;

a first rib hingedly attached to one of the seats;

a second rib hingedly attached to the other of the seats; and a third rib hingedly attached to the tabletop;

the first, second, and third ribs being movable between a collapsed position where they lie substantially parallel and adjacent to the seats and to the tabletop, respectively, and an assembled position where they extend substantially perpendicular to the seats and to the tabletop, respectively, and are adapted to fit respectively into the side notches and the middle notch of the bases to stabilize the picnic table.

* * * * *